US009415291B2

(12) United States Patent
Ota et al.

(10) Patent No.: US 9,415,291 B2
(45) Date of Patent: Aug. 16, 2016

(54) GOLF SWING ANALYZING APPARATUS AND METHOD OF ANALYZING GOLF SWING

(71) Applicants: Seiko Epson Corporation, Tokyo (JP); Keio University, Tokyo (JP)

(72) Inventors: Ken Ota, Fuchu (JP); Kazuhiro Shibuya, Shiojiri (JP)

(73) Assignees: Seiko Epson Corporation (JP); Keio University (JP)

( * ) Notice: Subject to any disclaimer, the term of this patent is extended or adjusted under 35 U.S.C. 154(b) by 174 days.

(21) Appl. No.: 14/043,374

(22) Filed: Oct. 1, 2013

(65) Prior Publication Data

US 2014/0100050 A1 Apr. 10, 2014

(30) Foreign Application Priority Data

Oct. 5, 2012 (JP) ..... 2012-223326
Nov. 1, 2012 (JP) ..... 2012-241509

(51) Int. Cl.
*A63B 60/42* (2015.01)
*A63B 69/36* (2006.01)
*A63B 71/06* (2006.01)

(52) U.S. Cl.
CPC ..... *A63B 69/3632* (2013.01); *A63B 71/0619* (2013.01); *A63B 2220/833* (2013.01); *A63B 2225/50* (2013.01)

(58) Field of Classification Search
CPC .... A63B 53/00; A63B 69/36; A63B 69/3608; A63B 69/3632; A63B 2069/3602
USPC ..... 473/222, 226, 223
See application file for complete search history.

(56) References Cited

U.S. PATENT DOCUMENTS

| | | | | |
|---|---|---|---|---|
| 8,109,816 | B1 | 2/2012 | Grober | |
| 2002/0107085 | A1* | 8/2002 | Lee | A63B 24/0003 473/221 |
| 2009/0017930 | A1 | 1/2009 | Burnett et al. | |
| 2009/0247312 | A1 | 10/2009 | Sato et al. | |
| 2010/0210371 | A1* | 8/2010 | Sato | A63B 59/0074 473/223 |
| 2010/0323805 | A1 | 12/2010 | Kamino et al. | |
| 2012/0128203 | A1 | 5/2012 | Nakaoka | |
| 2012/0157241 | A1 | 6/2012 | Nomura et al. | |
| 2012/0179418 | A1 | 7/2012 | Takasugi et al. | |
| 2013/0005496 | A1 | 1/2013 | Priester et al. | |

FOREIGN PATENT DOCUMENTS

| | | | |
|---|---|---|---|
| JP | 11-169499 | | 6/1999 |
| JP | 2004-024488 | A | 1/2004 |
| JP | 2008-073210 | A | 4/2008 |
| JP | 2009-125507 | A | 6/2009 |
| JP | 2009-240677 | A | 10/2009 |
| JP | 2010-011926 | A | 1/2010 |

OTHER PUBLICATIONS

Robert D. Grober, "An Accelerometer Based Instrumentation of the Golf Club; Comparative Analysis of Golf Swings", Department of Applied Physics, Yale University, New Haven, CT, Dec. 30, 2009, pp. 1-23.

* cited by examiner

*Primary Examiner* — Allen Chan
(74) *Attorney, Agent, or Firm* — Harness, Dickey & Pierce, P.L.C.

(57) ABSTRACT

An aspect of the invention relates to a golf swing analyzing apparatus, comprising: an arithmetic section operating to use the output of an inertial sensor to calculate bending moment acting on the golf club, the inertial sensor being attached to the golf club.

12 Claims, 5 Drawing Sheets

GOLF SWING ANALYZING APPARATUS AND METHOD OF ANALYZING GOLF SWING

This application is based upon and claims the benefit of priority from the prior Japanese Patent Application No. 2012-223326 filed on Oct. 5, 2012, and the prior Japanese Patent Application No. 2012-241509 filed on Nov. 1, 2012, the entire contents of which are incorporated herein by reference.

BACKGROUND

The present invention relates to a golf swing analyzing apparatus and a method of analyzing golf swings.

A golf swing analyzing apparatus is generally known as disclosed in Japanese Patent Application Publication No. 2010-11926, for example. The golf swing analyzing apparatus utilizes an optical motion capture system for capturing an image of a swing of a golfer. Markers are fixed to specific positions of the golfer and/or a golf club for the capture of the image of the swing. The movement of the markers is recorded as an image for determining the moving paths of the specific positions. In addition, a golf swing analyzing apparatus utilizing an acceleration sensor is also generally known as disclosed in Japanese Patent Application Publication No. 11-169499, for example. An acceleration sensor is attached to the golf club. The form of the golf swing is analyzed based on the acceleration measured by the acceleration sensor.

The shaft of the golf club is forced to bend during a golf swing. The bending of the golf club influences the distance and direction of drives or shots. The torque and force acting on the shaft from the golfer during a golf swing influences the bending of the golf club during the golf swing, so that determination of the torque and force is expected to greatly contribute to the design of rigidity of a shaft or the selection of a shaft suitable to the golfer. And further, if the changes of the torque and force are grasped along the elapse of time during the downswing, it is possible to quantify the tempo of respective actions during the golf swing, which is expected to contribute to improvement of the golf swing.

However, means is not so far proposed for measuring parameters related to the bending, such as torque and force, in a facilitated manner. Strain gauges are mounted on the golf club at respective locations and utilized to measure strain at the respective locations, thereby resulting in complicated measurement equipment. A golfer suffers from a lot of burden for the measurement.

SUMMARY

An aspect of the invention relates to a golf swing analyzing apparatus, comprising: an arithmetic section operating to use the output of an inertial sensor to calculate bending moment acting on the golf club, the inertial sensor being attached to the golf club.

Another aspect of the invention relates to a method of analyzing golf swings, comprising: processing the output of an inertial sensor to calculate bending moment acting on the golf club, the inertial sensor being attached to the golf club.

DESCRIPTION OF EXEMPLARY EMBODIMENTS

Figure 1:
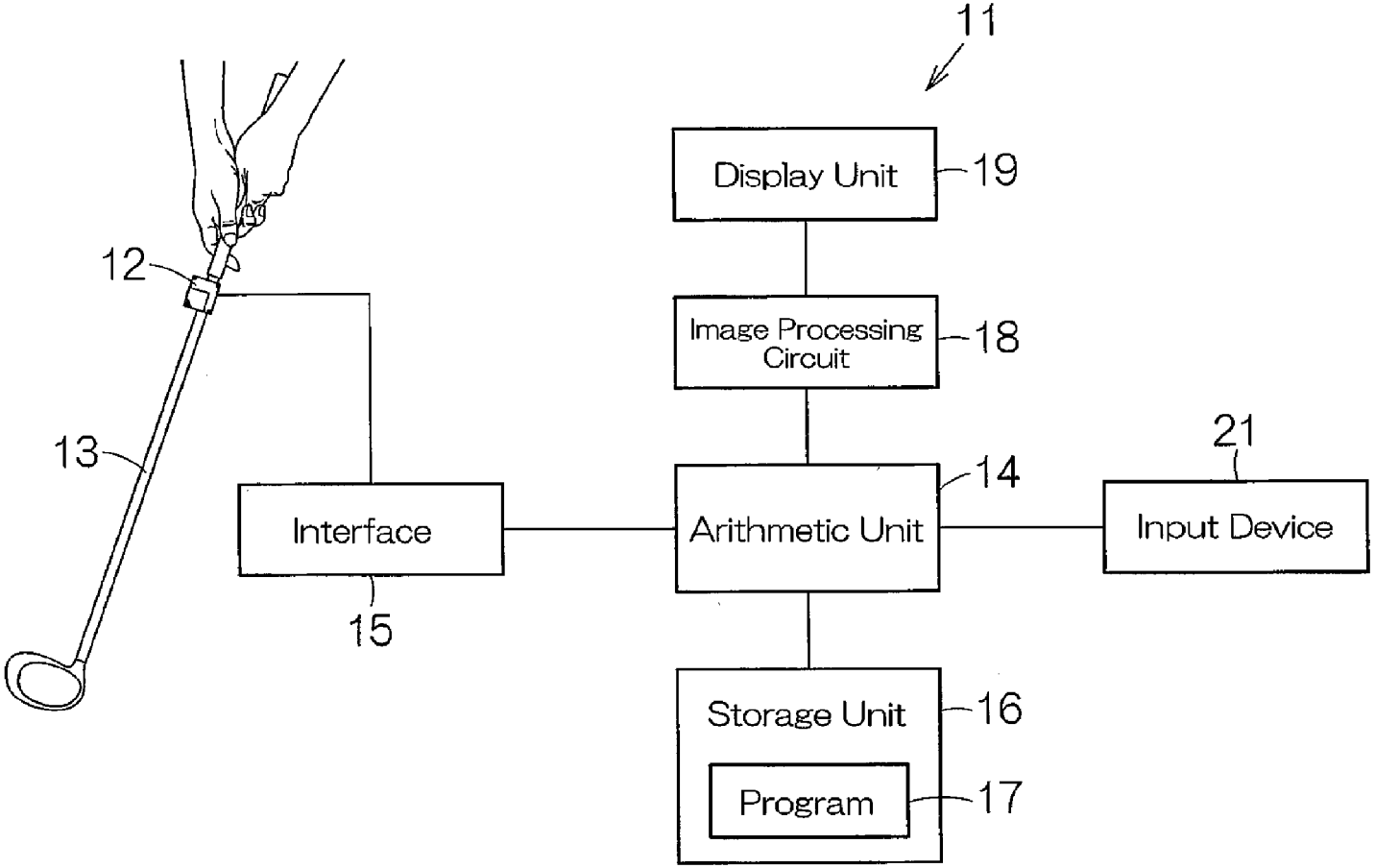
FIG. 1 is a schematic view illustrating the structure of a golf swing analyzing apparatus according to one exemplary embodiment of the invention.
Figure 2:
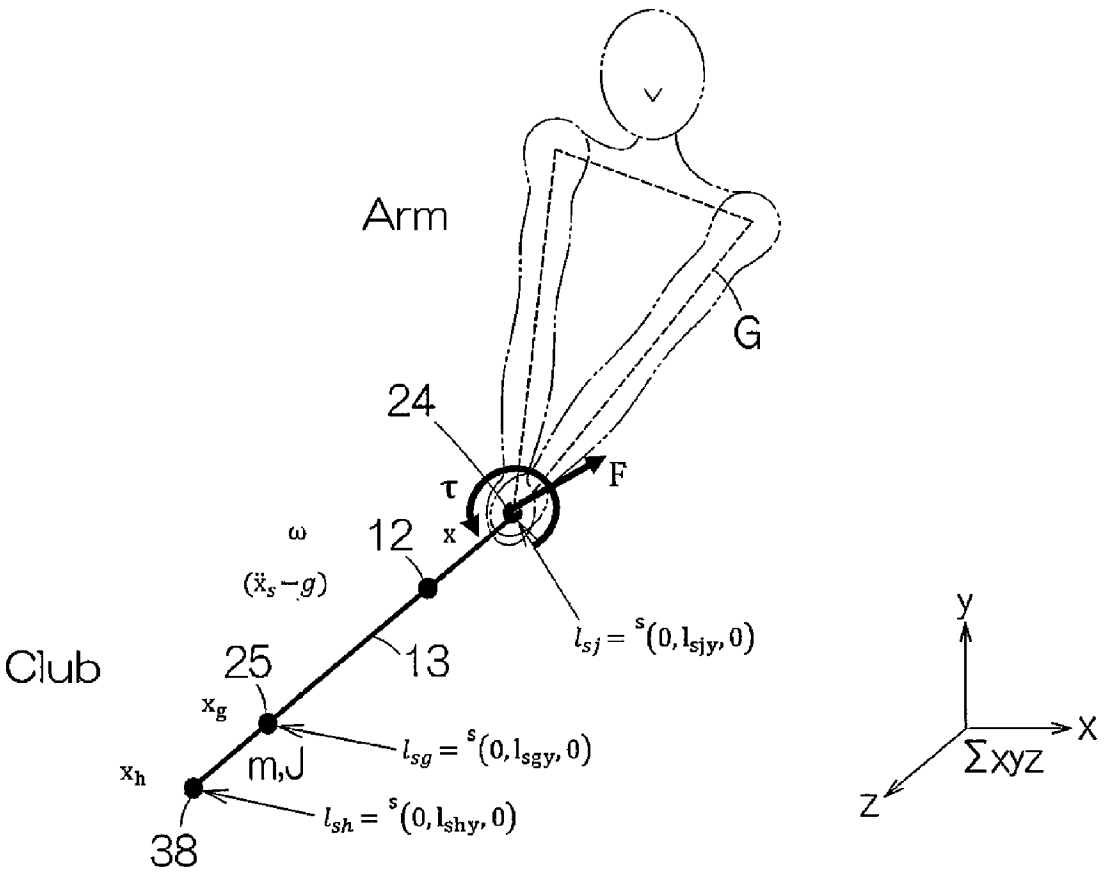
FIG. 2 is a schematic view illustrating an analysis model for a golf club.

According to at least one aspect of the invention, a golf swing analyzing apparatus and a method of analyzing golf swings are provided to usefully present the analysis on the bending of a golf club.

(a) An aspect of the invention relates to a golf swing analyzing apparatus comprising an arithmetic section operating to use an output of an inertial sensor to calculate bending moment acting on a golf club, the inertial sensor being attached to the golf club.

The golf swing analyzing apparatus enables derivation of the bending moment acting on the grip in a downswing of the golf club. The bending moment is supposed to engage in the occurrence of the bending of the golf club. The calculated bending moment is expected to present a guideline for the rigidity of the golf club, the tempo of the golf swing, and the like. The observation of the bending moment in this manner contributes to the analysis on the rigidity of the shaft suitable to the golfer, and the tempo of respective actions during the golf swing. For example, the calculated bending moment is expected to contribute to the design or selection of the golf club having the property of rigidity suitable to the golfer.

(b) The arithmetic section may operate to calculate the maximum value of the bending moment. The calculated maximum value of the bending moment is supposed to result from the form of golf swing. The observation of the maximum bending moment enables the analysis on the form of golf swing. For example, the repeated change of the form in combination with a subsequent observation results in a better improvement of the form of golf swing through try and error.

(c) The golf swing analyzing apparatus may include an image data generating section generating an image data for displaying the change of the bending moment. The golf swing analyzing apparatus is allowed to present a visual image of the change of the bending moment along the elapse of time to users. It contributes to the analysis of the rigidity of the shaft suitable to the golfer.

(d) The arithmetic section may operate to calculate the elapsed time from the beginning of the downswing to the establishment of the maximum value of the bending moment and the elapsed time from the establishment of the maximum value to the establishment of the minimum value of the bending moment. It is possible to identify the time point of the establishment of the maximum bending moment in the downswing of the golf club. This is expected to contribute to the analysis of the rigidity of the shaft suitable to the golfer.

(e) The golf swing analyzing apparatus may operate to calculate the time point of the establishment of the maximum value of the bending moment in a period from the beginning of the downswing to the impact to present the hardness of the shaft of the golf club. The presentation of the hardness of the shaft is expected to contribute to a better selection of the golf club suitable to the golfer.

(f) The inertial sensor may include an acceleration sensor and a gyro sensor. The acceleration sensor and the gyro sensor enable a precise detection of the acceleration and the angular velocity for the calculation of the bending moment.

(g) Another aspect of the invention relates to a method of analyzing golf swings, comprising: processing the output of an inertial sensor to calculate the bending moment acting on the golf club, the inertial sensor being attached to the golf club.

The method enables derivation of the bending moment acting on the grip in a downswing of the golf club. The bending moment is supposed to engage in the occurrence of the bending of the golf club. The calculated bending moment is expected to present a guideline for the rigidity of the golf club, the tempo of the golf swing, and the like. The observation of the bending moment in this manner contributes to the analysis on the rigidity of the shaft suitable to the golfer, and the tempo of respective actions during the golf swing. For example, the calculated bending moment is expected to contribute to the design or selection of the golf club having the property of rigidity suitable to the golfer.

A detailed description will be made below on an exemplary embodiment of the invention referring to the attached drawings. It is to be understood that both the foregoing general description and the following detailed description are exemplary and explanatory and are not restrictive of the invention as claimed, and all elements of the exemplary embodiment may not be indispensable to a solution of the invention.

(1) Structure of Golf Swing Analyzing Apparatus

FIG. 1 schematically illustrates the structure of a golf swing analyzing apparatus 11 according to one embodiment of the invention. The golf swing analyzing apparatus 11 includes an inertial sensor 12, for example. The inertial sensor 12 includes an acceleration sensor and a gyro sensor assembled therein. The acceleration sensor is configured to detect the acceleration in the directions of three axes of an orthogonal coordinate system. The gyro sensor is configured to detect the angular velocity around each of three axes of an orthogonal coordinate system. The inertial sensor 12 outputs detection signals. The detection signals specify the magnitude of the acceleration and the angular velocity for the individual axes of an orthogonal coordinate system. The acceleration sensor and the gyro sensor are expected to detect the acceleration and the angular velocity with a relatively high accuracy, respectively. The inertial sensor 12 is attached to a golf club 13. The inertial sensor 12 may be fixed to the golf club 13 in an immobilized manner. Here, a detection axis of the inertial sensor 12 is set in parallel with the longitudinal axis of the golf club 13.

The golf swing analyzing apparatus 11 includes an arithmetic unit 14. The inertial sensor 12 is connected to the arithmetic unit 14. An interface circuit 15 is connected to the arithmetic unit 14 for the connection of the inertial sensor 12. The interface circuit 15 may be connected to the inertial sensor 12 with or without wires. The arithmetic unit 14 receives the detection signals from the inertial sensor 12.

A storage unit 16 is connected to the arithmetic unit 14. For example, a golf swing analyzing software program 17 and related data are stored in the storage unit 16. The arithmetic unit 14 executes the golf swing analyzing software program 17 to realize a method of analyzing golf swings. The storage unit 16 may include a dynamic random access memory (DRAM), a large capacity storage unit, a non-volatile memory, and the like. For example, the DRAM temporarily holds the golf swing analyzing software program 17 for the realization of the method of analyzing golf swings. The golf swing analyzing software program 17 and data are stored in the large capacity storage unit such as a hard disk drive unit (HDD). A relatively small program such as a basic input/output system (BIOS) and relatively small data may be stored in the non-volatile memory.

An image processing circuit 18 is connected to the arithmetic unit 14. The arithmetic unit 14 supplies image data to the image processing circuit 18. A display unit 19 is connected to the image processing circuit 18. An interface circuit, not depicted, is connected to the image processing circuit 18 for the connection of the display unit 19. The image processing circuit 18 supplies imaging signals to the display unit 19 in accordance with the supplied image data. The imaging signals determine images displayed on the screen of the display unit 19. A liquid crystal display or any other type of a flat panel display may be utilized as the display unit 19. Here, the arithmetic unit 14, the storage unit 16 and the image processing circuit 18 are provided in the form of a computer apparatus, for example.

An input device 21 is connected to the arithmetic unit 14. The input device 21 at least includes alphabetical keypads and numeric keypads. The input device 21 is utilized to input alphabetical information and numeric information to the arithmetic unit 14. The input device 21 may be a keyboard, for example.

The inertial sensor 12 outputs acceleration signals and angular velocity signals. The acceleration signal from the inertial sensor 12 specifies the acceleration including the effect of the gravity g as follows:

$$\ddot{x}_s - g \qquad \text{[Mathematical Expression 1]}$$

The angular velocity signal from the inertial sensor 12 specifies the angular velocity ω.

The arithmetic unit 14 fixes a local coordinate system $\Sigma_L$ to the golf club 13. The local coordinate system $\Sigma_L$ has the coordinate axes represented by (η, ξ, l). The local coordinate system $\Sigma_L$ has the origin coincident with the grip 24 of the golf club 13. The grip 24 forms the fulcrum of the pendulum movement. The coordinate axis l is aligned with the longitudinal axis or central axis of the golf club 13, for example. The unit vector $e_l$ is set in the direction of the coordinate axis l in the local coordinate system $\Sigma_L$.

(2) Structure of Arithmetic Unit

Figure 3:
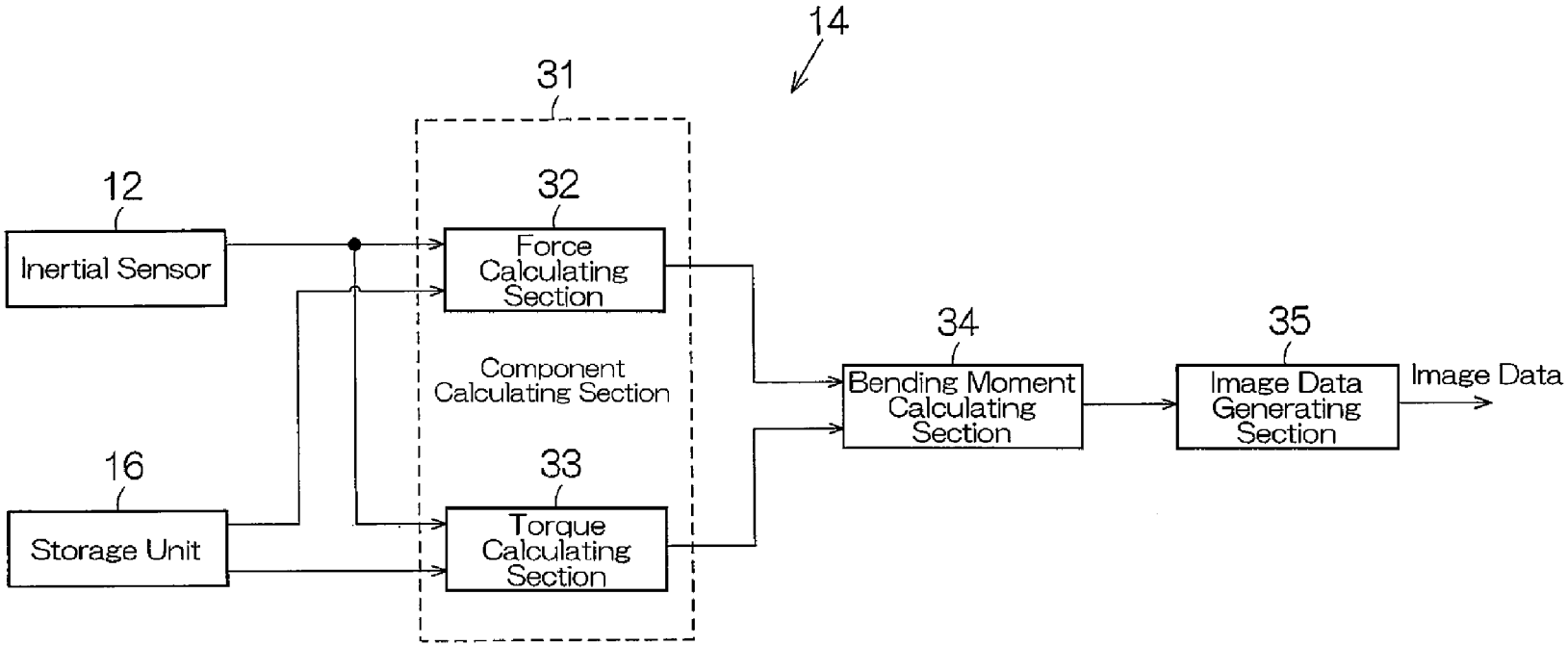
FIG. 3 is a block diagram schematically illustrating the structure of an arithmetic unit.

FIG. 3 schematically illustrates the structure of a part of the arithmetic unit 14. The arithmetic unit 14 includes a component calculating section 31. The acceleration signal and the angular velocity signal are input to the component calculating section 31 from the inertial sensor 12. The component calculating section 31 calculates, based on the supplied acceleration signal and the supplied angular velocity signal, componential values required in the calculation of the energy change rate. The component calculating section 31 obtains various values from the storage unit 16 for the calculation of the energy change value.

The component calculating section 31 includes a force calculating section 32. The force calculating section 32 calculates the internal force F acting on the golf club 13. The force calculating section 32 obtains the acceleration signal from the inertial sensor 12 and a mass data of the golf club 13 for the calculation of the internal force F. The mass data specifies the mass m of the golf club 13. The mass data may previously be stored in the storage unit 16. The internal force F is calculated in accordance with the following mathematical expression:

$$F=m(\ddot{x}_g-g) \quad \text{[Mathematical Expression 2]}$$

In this case, the following component represents the acceleration of the centroid 25 of the golf club 13:

$$(\ddot{x}_g-g) \quad \text{[Mathematical Expression 3]}$$

The constant g represents the gravity. The acceleration of the centroid 25 is determined based on the measurement of the inertial sensor 12. The force calculating section 32 outputs an internal force signal specifying the value of the internal force F.

The component calculating section 31 includes a torque calculating section 33. The torque calculating section 33 calculates torque τ acting on the golf club 13 around the grip 24. The torque calculating section 33 obtains the angular velocity signal from the inertial sensor 12, an inertia tensor data, a length data, and the internal force signal for the calculation of the torque τ. The inertia tensor data specifies the inertia tensor J of the golf club 13. The length data specifies the length $l_g$ between the grip 24 (fulcrum) and the centroid 25. The inertia tensor data and the length data may previously be stored in the storage unit 16. The internal force signal may be supplied from the force calculating section 32. The torque τ is calculated in accordance with the following mathematical expression:

$$\tau=J\dot{\omega}+\omega\times J\omega+l_g e_l\times F \quad \text{[Mathematical Expression 4]}$$

The torque calculating section 33 outputs a torque signal specifying the value of the torque τ.

The arithmetic unit 14 includes a bending moment calculating section 34. The bending moment calculating section 34 calculates the bending moment, including the maximum value of the bending moment, acting on the golf club 13. The bending moment calculating section 34 obtains the angular velocity signal of the inertial sensor 12 and the inertia tensor data for the calculation of the bending moment. The bending moment is derived in accordance with the following mathematical expression:

$$J\dot{\omega}+\omega\times J\omega=\tau-l_g e_l\times F \quad \text{[Mathematical Expression 5]}$$

The bending moment calculating section 34 outputs a bending moment signal specifying the value of the bending moment. Here, the bending moment calculating section 34 calculates the torque ($l_g e_l\times F$) resulting from the internal force F of the golf club 13. In this case, the bending moment calculating section 34 outputs a torque component signal specifying the value of the torque ($l_g e_l\times F$) and the value of the torque τ. Alternatively, the bending moment may be calculated in accordance with the right side of the equation in the mathematical expression 5. In this case, the bending moment calculating section 34 may obtain the length data from the storage unit 16, the torque signal from the torque calculating section 33, and the internal force signal from the force calculating section 32.

The bending moment signal and the torque component signal are supplied to an image data generating section 35. The image data generating section 35 generates a first image data for visualizing the changes of the bending moment, the torque τ and the torque ($l_g e_l\times F$) along the elapse of time based on the bending moment signal and the torque component signal. The first image data is output toward the image processing circuit 18.

The image data generating section 35 is configured to extract the maximum value of the bending moment from the bending moment signal. The extracted maximum value is utilized to generate a maximum bending moment data. The maximum bending moment data specifies the maximum value of the bending moment. The image data generating section 35 may form in the first image data an image visualizing the maximum bending moment data.

The image data generating section 35 is also configured to calculate the elapsed time from the beginning of the downswing to the establishment of the maximum value (a peak value) of the bending moment and the elapsed time from the establishment of the maximum value (a positive peak value) to the establishment of the minimum value (a negative peak value) of the bending moment. A swing tempo data is generated based on the calculated elapsed times. The swing tempo data specifies the mentioned elapsed times. The image data generating section 35 may generate a second image data visualizing the swing tempo data. The second image data may contain an image visualizing the changes of the bending moment, the torque τ and the torque ($l_g e_l\times F$). The second image data is output toward the image processing circuit 18.

(3) Performance of Golf Swing Analyzing Apparatus

A brief description will be made on the performance of the golf swing analyzing apparatus 11. First of all, the golf swing of a golfer is measured. Required information is input to the arithmetic unit 14 through the input device 21 prior to the measurement of a golf swing. Here, one is instructed to input the information including the mass m of the golf club 13, the inertia tensor J of the golf club 13 around the grip 24, the length l between the grip 24 (fulcrum) and the centroid $x_g$ of the golf club 13. The input information is controlled under a predetermined identifier, for example. The identifier may be utilized to discriminate a predetermined golfer.

The inertial sensor 12 is attached to the golf club 13 prior to the measurement of a golf swing. The inertial sensor 12 is fixed to the golf club 13 in an immobilized manner. The inertial sensor 12 starts operating to measure prior to the execution of a golf swing. When a golfer thereafter makes a golf swing, the inertial sensor 12 keeps operating to continuously measure the acceleration and the angular velocity at predetermined intervals. The size of the intervals determines the resolution of the measurement. The detection signal of the inertial sensor 12 may be transmitted to the arithmetic unit 14 in a realtime fashion, or temporarily be stored in a storage device incorporated in the inertial sensor 12. In the latter case, the detection signal may be transmitted to the arithmetic unit 14 with or without wires after the completion of the golf swing.

Figure 4:
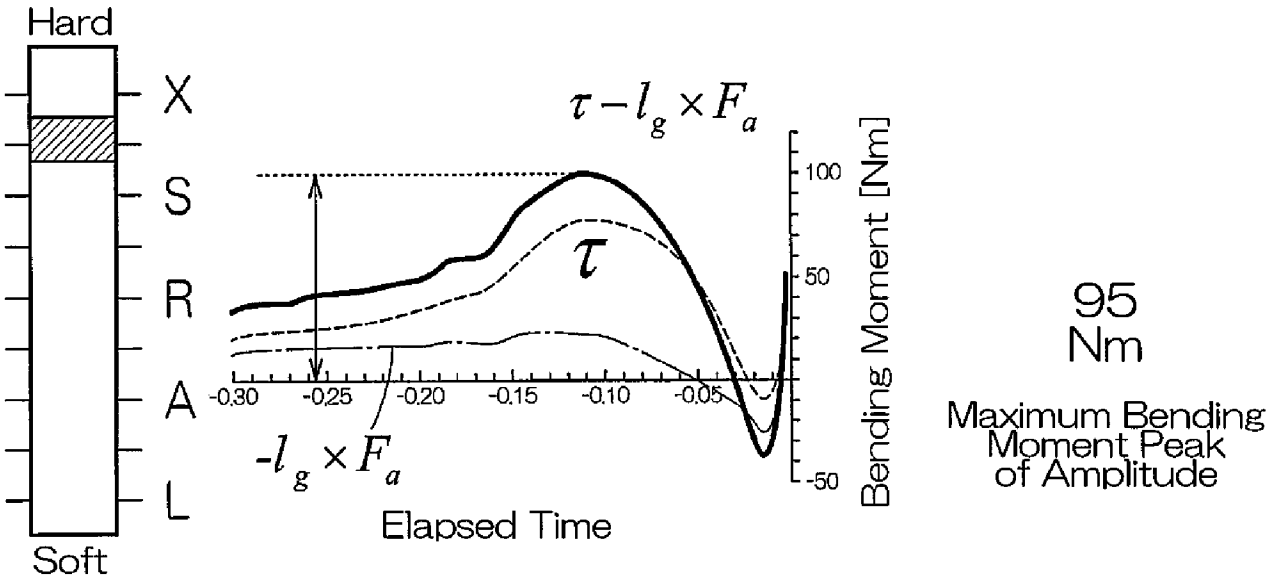
FIG. 4 is a displayed image according to one example, including a graph illustrating bending moment and changes of respective torques as well as the maximum bending moment.

The inventors have examined the performance of the golf swing analyzing apparatus 11. The inventors observed the bending moment signal and the torque component signal in the examination. FIG. 4 is a graph having the axis of abscissas presenting the elapsed time [s(econd)] and the axis of ordinates presenting the bending moment [Nm]. The curved lines present the status in a period between the beginning of the downswing and the moment of the impact. 0[s] of the axis of abscissas indicates the moment when the golf club impacts on the golf ball in the figure. For example, −0.30[s] indicates the moment 0.30 seconds before the impact. As depicted in FIG. 4, the change of the bending moment acting on the golf club 13 can be visualized along the elapse of time. It has been confirmed that the maximum bending moment appears at a predetermined time point in the downswing. The value of the maximum bending moment is presented in the visual image on the screen of the display unit 19 in accordance with the second image data.

The golf swing analyzing apparatus 11 is utilized to measure the bending moment acting on the grip 24 in the downswing of the golf club 13. The bending moment is supposed to engage in the occurrence of the bending of the golf club. The calculated bending moment is expected to present a guideline for the rigidity of the golf club as depicted in the left side of FIG. 4, for example. Here, the hardness of the shaft is categorized in sequence from the harder side in X rank, S rank, R rank, A rank and L rank. This exemplary embodiment depicts an example of determination that a relatively hard shaft, having the hardness between the S rank and the X rank, fits the golfer.

And, the bending moment and the maximum bending moment result from the form of golf swing. The maximum bending moment represents the maximum torque acting on the grip 24 of the golf club 13 in the downswing of the golf club 13. The observation of the bending moment in this manner serves to contribute to the analysis of the form of golf swing. For example, the repeated change of the form in combination with the observation results in a better improvement of the form of golf swing through try and error. The golf swing analyzing apparatus 11 is allowed to present a visual image of the change of the bending moment along the elapse of time to users. It thus contributes to the establishment of an efficient guideline for the form of golf swing.

Figure 5:
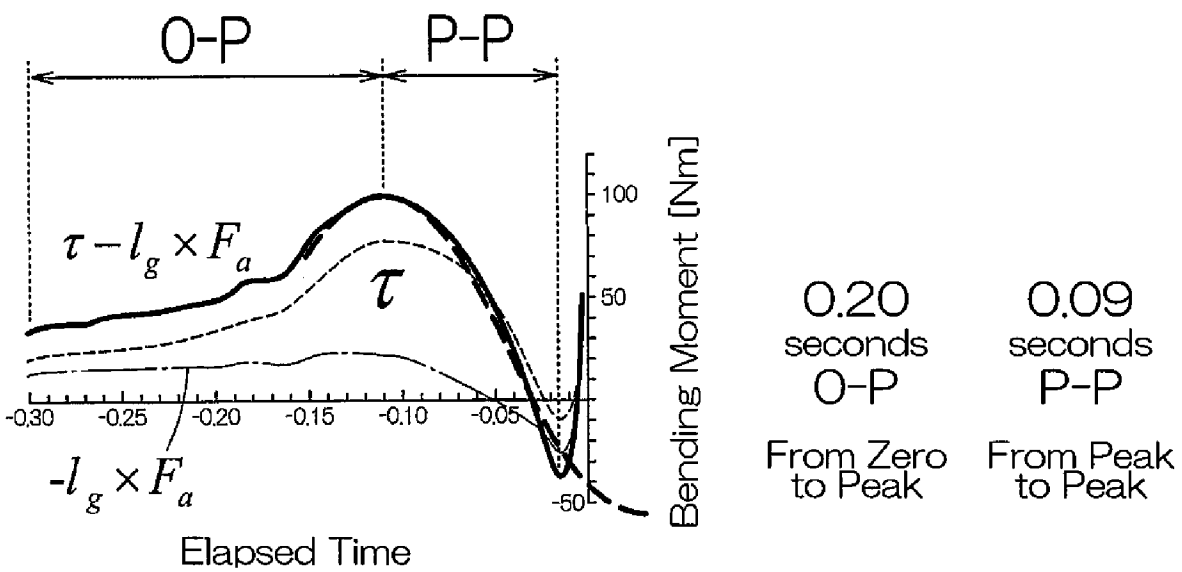
FIG. 5 is a displayed image according to one example, including a graph illustrating bending moment and changes of respective torques as well as the time point of establishment of the maximum bending moment.

Likewise, the inventors have examined the tempo of golf swing. FIG. 5 illustrates the tempo of golf swing employing the data of FIG. 4. As depicted in FIG. 5, the inventors calculated the elapsed time (interval O-P) between the beginning of the downswing (the left end of the graph) and the establishment of the maximum (positive peak) value of the bending moment and the elapsed time (interval P-P) between the establishment of the maximum (positive peak) value and the establishment of the minimum (negative peak) value. The interval O-P took 0.20[s] and the interval P-P took 0.09[s] in this embodiment. The ratio of the elapsed time in a period before the establishment of the maximum torque in the downswing to the elapsed time in a period after the establishment of the maximum torque in the downswing is presented to users as "swing tempo". The tendency of the tempo such as a longer time in the first half, a longer time in the second half, or the like presents a guideline for the hardness of the shaft.

The timing of the establishment of the maximum bending moment is in this manner determined in the downswing of the golf club in this embodiment. The observation of such bending moment contributes to the analysis of the form of golf swing. The repeated change of the form in combination with a subsequent observation is expected to result in a better improvement of the form of golf swing through try and error.

It should be noted that it is easily conceivable to a person having ordinary skills in the art to make various modification on the embodiment substantially within the scope of the novel features and effects of the invention although the exemplary embodiment has been described above in detail. The scope of the invention covers all the modifications. For example, the terminology at least once used to mean a broader or similar meaning in the subject specification and attached drawings may have the identical coverage even in the other part of the specification and drawings. In addition, the components and operation of the golf swing analyzing apparatus 11, the inertial sensor 12, the arithmetic unit 14, and the like may not be limited to ones described in the embodiment, and various modification may be made.

What is claimed is:

1. A golf swing analyzing apparatus comprising:

a force calculating section calculating an internal force acting on a golf club, wherein the golf club includes a grip and an inertial sensor attached to the golf club, and the force calculating section calculates the internal force based on an output of the inertial sensor and a mass data of the golf club;

a torque calculating section calculating a torque acting on the golf club around the grip at a length from the grip; and an arithmetic section calculating a bending moment acting on the golf club based on the internal force and the torque.

2. The golf swing analyzing apparatus according to claim 1, wherein the arithmetic section operates to calculate a maximum value of the bending moment.

3. The golf swing analyzing apparatus according to claim 1, including an image data generating section generating an image data for displaying a change of the bending moment.

4. The golf swing analyzing apparatus according to claim 1, wherein the arithmetic section operates to calculate an elapsed time from a beginning of a downswing to an establishment of a maximum value of the bending moment and an elapsed time from the establishment of the maximum value to an establishment of a minimum value of the bending moment.

5. The golf swing analyzing apparatus according to claim 4, wherein the apparatus operates to calculate a time point of the establishment of the maximum value of the bending moment in a period from the beginning of the downswing to an impact to present a hardness of a shaft of the golf club.

6. The golf swing analyzing apparatus according to claim 1, wherein the inertial sensor includes an acceleration sensor and a gyro sensor.

7. A method of analyzing golf swings, comprising:

calculating an internal force acting on a golf club having a grip and an inertial sensor attached to the golf club, wherein the internal force is calculated based on an output of the inertial sensor and a mass data of the golf club;

calculating a torque acting on the golf club around the grip at a length from the grip; and calculating a bending moment acting on the golf club based on the internal force and the torque.

8. The golf swing analyzing apparatus according to claim 1, wherein the arithmetic section calculates the bending moment based on the torque, the length, and the internal force in accordance with the following formula in which M is the bending moment, $\tau$ is the torque, $l_g$ is the length, and F is the internal force:

$$M=\tau-l_g\times F.$$

9. The golf swing analyzing apparatus according to claim 1 further comprising:

an image data generating section generating an image data for displaying changes of the torque and the internal force.

10. The golf swing analyzing apparatus according to claim 1 further comprising:

an image data generating section generating an image data for displaying changes of the torque and the internal force; and a display unit displaying an image of the changes of the torque and the internal force based on the image data from the image data generating section.

11. The method of analyzing golf swings of claim 7 further comprising:

generating an image data for displaying changes of the torque and the internal force; and displaying an image of the changes of the torque and the internal force based on the image data on a display unit.

12. The method of analyzing golf swings of claim 7 further comprising:

generating an image data for displaying a change of the bending moment; and displaying an image of the changes of the bending moment based on the image data on a display unit.

* * * * *